US005214255A

United States Patent [19]

Fleischhauer

[11] Patent Number: 5,214,255

[45] Date of Patent: May 25, 1993

[54] SWITCH MECHANISM FOR A MULTIPLE FILAMENT ELECTRIC LAMP

[76] Inventor: Eugene T. Fleischhauer, 1413 Wesanne La., Midlothian, Va. 23113

[21] Appl. No.: 647,418

[22] Filed: Jan. 29, 1991

[51] Int. Cl.[5] ..... H01R 19/54

[52] U.S. Cl. ..... 200/51.15; 200/292; 200/51.017

[58] Field of Search ..... 200/51.15, 51.17, 51.02, 200/51.03, 51.04, 51.05, 51.06, 292

[56] References Cited

U.S. PATENT DOCUMENTS

| | | | |
|---|---|---|---|
| 625,219 | 5/1899 | Truitt . | |
| 1,666,248 | 4/1928 | Schuldt . | |
| 2,075,436 | 3/1937 | Grossman et al. | 200/51.15 |
| 2,139,762 | 12/1938 | Major | 200/51.15 X |
| 2,222,655 | 11/1940 | Dolberg . | |
| 4,104,565 | 8/1978 | Klassen | 200/51.06 |
| 4,668,845 | 5/1987 | Izumi | 200/51.15 |

FOREIGN PATENT DOCUMENTS

| | | | |
|---|---|---|---|
| 566941 | 2/1924 | France | 200/51.06 |

*Primary Examiner*—Ernest G. Cusick
*Attorney, Agent, or Firm*—Hughes & Multer

[57] ABSTRACT

A switching device for a multi-filament electric lamp. The filaments of the electric lamp are electrically connected to arcuate contact surfaces arranged in a circle. The conductive bar is arranged to rotate about the axis of the circular arrangement of contact surfaces. The ends of the conductive bar contact the contact surfaces, and an electric power supply is electrically connected to the center portion of the conductive bar. Current flows into the center portion of the bar and out both ends and through the filaments of the electric lamp in the patterns determined by actuation of a pull-chain to operate the lamp in LOW, MEDIUM, and HIGH states. With the conductive bar in a further, pull-chain determined position, the lamp is OFF.

8 Claims, 5 Drawing Sheets

SWITCH MECHANISM FOR A MULTIPLE FILAMENT ELECTRIC LAMP

TECHNICAL FIELD OF THE INVENTION

The present invention relates to sockets and switch mechanisms, electric lamps and, more specifically, to novel, improved pull-chain actuated switch mechanisms for energizing multifilament electric lamps.

BACKGROUND OF THE INVENTION

A number of multiple filament lamp sockets and other superficially related lamp sockets have heretofore been proposed. Those of which the applicant are aware are disclosed in U.S. Pat. Nos. 2,222,655 issued Nov. 26, 1942 to Dulberg for "MULTIPLE FILAMENT LAMP COMBINATION"; 1,666,248, issued Apr. 17, 1928 to Schultz for "THREE-WAY LAMP SOCKET"; and 625,219 issued May 16, 1899 to Truitt for "ELECTRIC SWITCH"; and also, LEVITON has a switch and socket device on the market.

Each of the foregoing references discloses switching devices that are incapable of pull-chain control of a multiple filament electric lamp. The Schultz and LEVITON switch and socket mechanisms are designed only to control single filament electric lamps.

The LEVITON device has four arcuate surfaces in a circle on a non-conductive support member. Contacts are formed on two arcuate surfaces in opposing quadrants. One contact is connected to an electric power source, and the other contact is connected to the filament of a single filament electric lamp. A conductive bar rotates from an "OFF" position in which it rests on the non-conductive support member to an "ON" position in which it rests on the contacts. In the "ON" condition, current may flow from the power source, through the conductive bar, and through the filament. The filament is thus energized, and the light bulb becomes luminous. The conductive bar is rotated using a standard pull-chain type rotation actuator. The LEVITON device would energize only one filament of a standard multiple filament electric lamp.

On the other hand, Truitt and Dulberg, while allowing control of a multi-filament lamp, do not provide for control of such lamps using a pull-chain actuating device.

SUMMARY OF THE INVENTION

There have been invented, and disclosed herein, certain new and novel switch mechanisms for multiple filament electric lamps that energize such lamps using a pull-chain actuator.

In the present invention, upwardly slanted, arcuate, contact surfaces are arranged in a circle on a contact support member. The contact surfaces are electrically connected to filaments of a multi-filament lamp. A conductive rod rotates about the axis of the circular arrangement of arcuate surfaces, with each end of the conductive rod contacting one of the contact surfaces. The conductive rod is electrically connected to an electrical power source. Current may flow out the ends of the conductive rod, through the contact surfaces, and into the filaments of the multi-filament lamp to energize these filaments. As the conductive rod is rotated about the axis of the circular arrangement, different combinations of filaments of the multi-filament lamp are be energized.

Further, the ends of the conductive rod and the contact surfaces may be modified to disconnect one or both ends of the conductive rod from one or more of the contacts.

A known pull-chain actuator is employed to rotate the conductive bar about the axis of the circular arrangement to energize different combinations of filaments in the electric lamp.

OBJECTS OF THE INVENTION

From the foregoing, it will be apparent that one important and primary object of the present invention is to provide a novel pull-chain operated switch for a multifilament electric lamp.

Further objects of the invention reside in the provision of electric switch devices as characterized in the preceding object that:

are easily adapted from currently used pull-chain type rotating mechanisms;

allow different combinations of filaments to be energized with successive pulls of a pull-chain;

may easily be adapted to energized standard multifilament electrical lamps:

allow generation of varying intensities of light, including an "off" state, by energizing different combination of filaments; and are rugged, lightweight, and easily and cheaply manufactured with presently available manufacturing technics.

DETAILED DESCRIPTION OF THE INVENTION

Figure 1A:
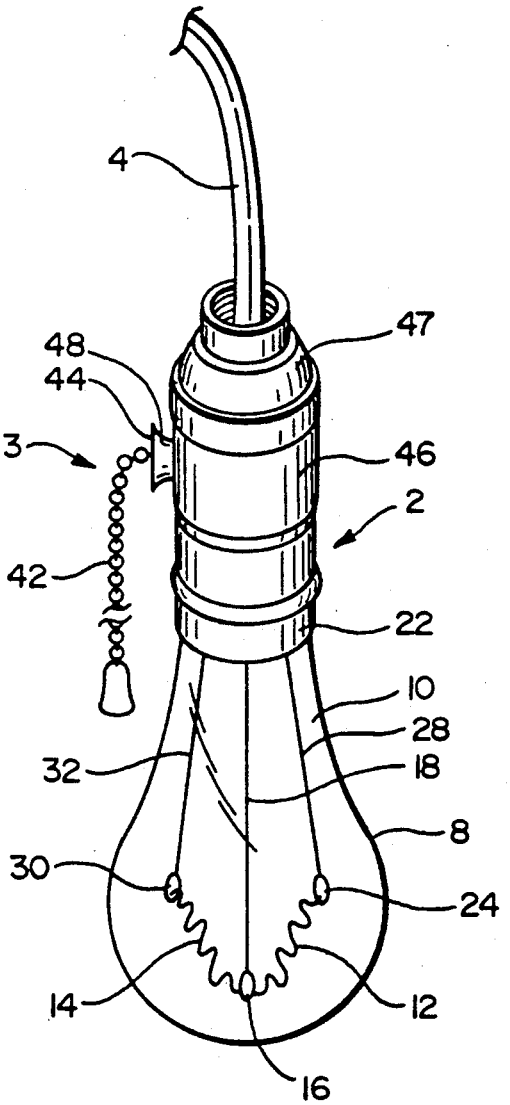
FIG. 1A is a perspective view of a pull-chain operated switch and socket mechanism with a multi-filament lamp socketed therein.
Figure 1B:
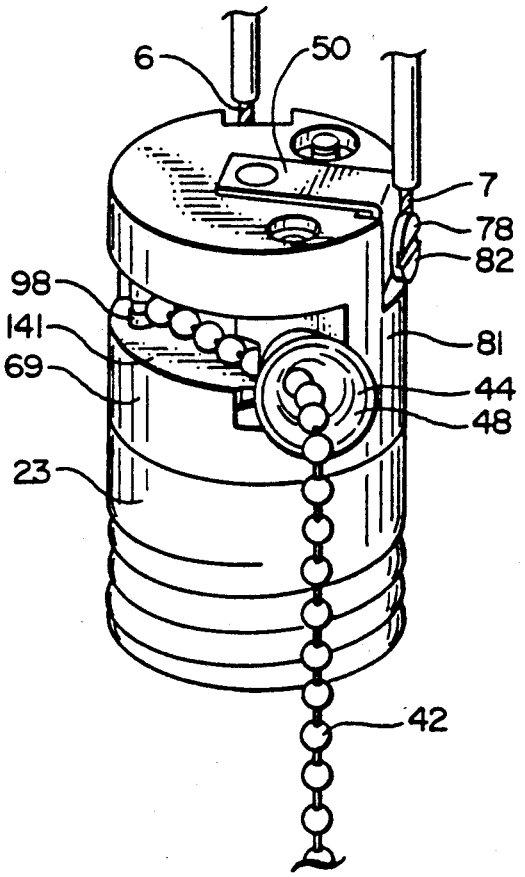
FIG. 1B is another perspective view of the switch and socket mechanism of the present invention with its casing removed.
Figure 2:
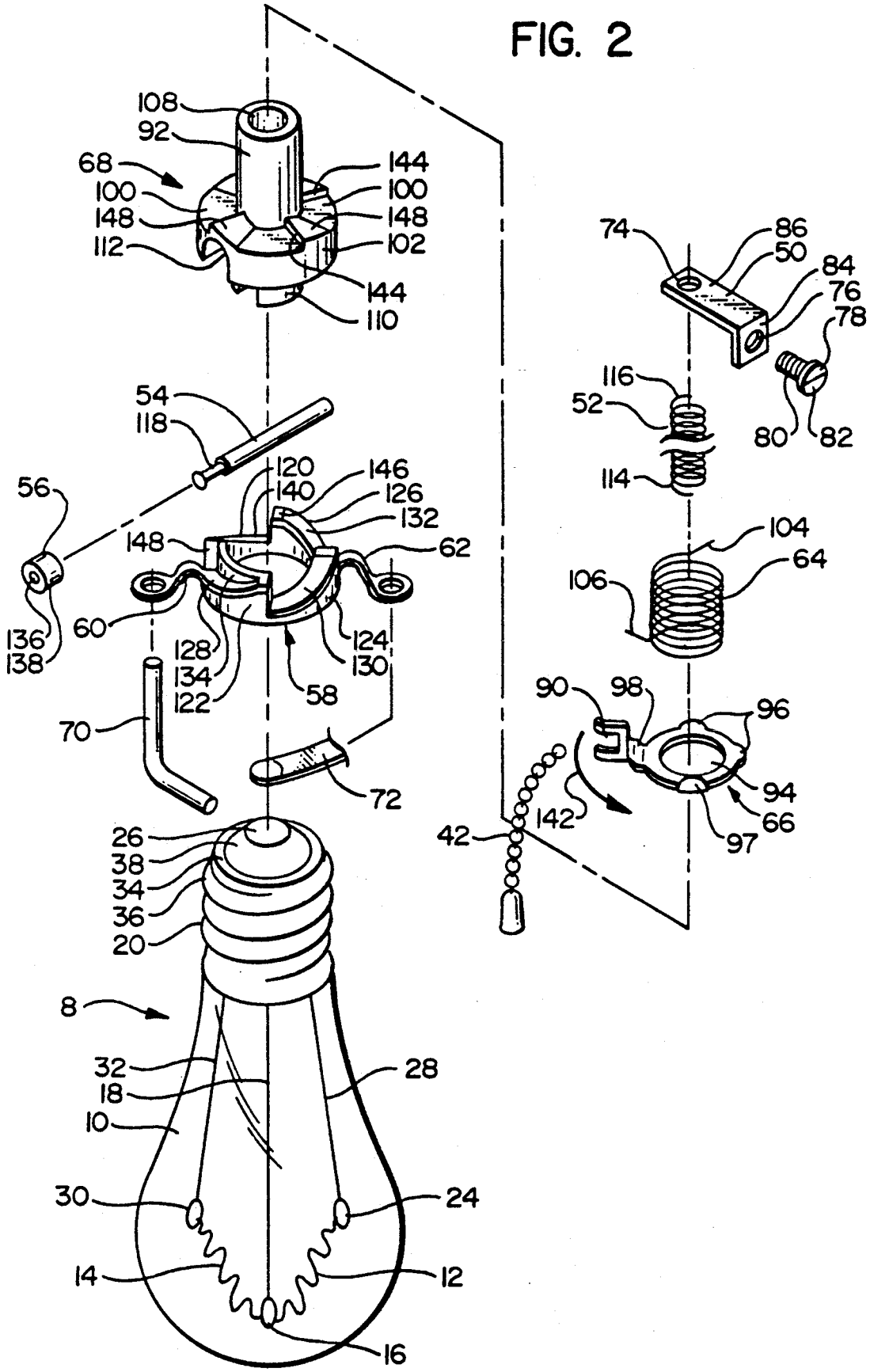
FIG. 2 is an exploded view depicting the primary components of a switch and pull-chain actuator constructed in accordance with, and embodying, the principles of the present invention.

Shown in FIGS. 1A, 1B, and 2 is a lamp socket and pull-chain actuator which embody the principles of the present invention and are generally indicated by reference characters 2 and 3, respectively. Socket 2 is suspended from a power cord 4. Power cord 4 contains supply and return conductors 6 and 7 which are connected to an AC power source 5 (FIGS. 4–7, 9–12, and 14–17).

Indicated at 8 is a multi-filament electric bulb mounted within socket 2. Light bulb 8 is well-known in the field and will be described herein only to the extent necessary for an understanding of the present invention.

Located within a generally transparent housing 10 of bulb 8 are high and low filaments 12 and 14, respectively. An end of filament 12 and an end of filament 14 are connected to a return terminal 16. Return terminal 16 is connected via a conductor 18 to a threaded bulb casing 20, which is shown in FIG. 2.

Formed on the inside of lower end 22 of socket 2 is a threaded contact 23 designed to mate with threaded bulb casing 20 of light bulb 8. Threaded contact 23 is connected to the return conductor 7 of power cord 5.

The opposite end of filament 12 is connected to terminal 24. Terminal 24 is connected to a center contact 26 via a conductor 28. Center contact 26 is formed at the apex of light bulb 8 as shown in FIG. 2.

Filament 14 is connected at its other end to a terminal 30, which is connected through a conductor 32 to an annular contact 34 formed on the upper end 36 of light bulb 8.

Center contact 26 and annular contact 34 are separated by an insulating portion 38. Center contact 26 is circular in top view and is coaxially aligned with annular contact 34 along an axis indicated by reference character 40 in FIG. 2.

A pull-chain 42 protrudes through an aperture 44 in lower casing 46 of socket 2. (An upper casing is indicated by reference character 47). Pull-chain 42 is supported by an annular support member 48.

The construction of socket 2 is shown in more detail in FIG. 2. The socket 2 has a metallic contact 50 and conductive spring 52. Those connect an electric switch of the invention to the supply conductor 6 in cable 4. The electric switch includes: (a) metallic rod or bar 54; (b) an insulator such as non-conductive bar or roller 56; (c) polymeric contact support member or base 58; (d) low filament terminal 60; and (e) high filament terminal 62.

The pull-chain rotation actuator 3 used to actuate the electric switch consists of: (a) pull-chain actuator such as the pull-chain 42; (b) rotation spring 64; (c) metal rotator 66; (d) plastic rotator 68; (e) conductive spring 52; and (f) a polymeric housing or casing 69.

The polymeric casing 69 (FIG. 1A) is molded such that: (a) it is generally cylindrical in shape; (b) its outer surface conforms to the inner surface of casing 46 of socket 2; and (c) it has a hollowed center and grooves for receiving the pull-chain actuator, electric switch, and conductors 70 and 72.

Conductors 70 and 72 protrude from the polymeric casing 69 inside of lower end portion 22. When threaded bulb casing 20 of light bulb 8 is fully screwed into threaded contact 23 inside of end portion 22 of socket 2, the following electrical connections are made: (a) terminal 60 is connected by conductor 70 to annular contact 34; and (b) terminal 62 is connected to center contact 26 by conductor 72.

Metal contact 50 is generally L-shaped and has holes 74 and 76 formed in the distal end portion 84 and 86 thereof. A screw 78 penetrates hole 76 to: (a) attach the supply conductor 6 in power supply cord 4 to metallic contact 50; and (b) secure metallic contact 50 to the outer surface 81 of the polymeric housing. Threaded portion 80 of screw 78 extends through in the cylindrically shaped actuator 69. The end of the supply conductor 6 is wrapped around threaded portion 80 of screw 78 and is securely held between head 82 thereof and metallic contact 50.

When attached to the polymeric housing 69 as above-described, elongate portion 86 of contact 50 extends along the end surface of the housing such that hole 74 is aligned with axis 40 (FIG. 1B).

Pull-chain 42 is inserted into slot 90 of metal rotator 66. End 92 of plastic rotator 68 is inserted through hole 94 in metal rotator 66. When end 92 is fully inserted, tabs 96 and groove projection 98 reside in flat spaces 100 on middle portion 102 of plastic rotator 68.

Rotation spring 64 is placed around end portion 92. End 104 of spring 64 is secured to actuator housing 69, while end 106 thereof is secured to groove projection 98 of metal rotator 66. So arranged, a force exerted by rotation spring 66 opposes counter-clockwise rotation of metal rotator 66 by pull-chain 42.

Conductive spring 52 is inserted into hole 106 in plastic rotator 68. Hole 108 extends completely through rotator 68 to the lower end 110 thereof.

Conductive rod 54 is installed in a groove 112 formed in plastic rotator 68. Groove 112 extends completely through bottom portion 110 and partly through middle portion 102 of plastic rotator 68. Groove 112 is transverse to axis 40.

Lower end 114 of conductive spring 52 extends through hole 108 and contacts conductive rod 54 along axis 40. Upper end 116 of spring 52 abuts an upper, inner end surface of the actuator housing 69. Further, end 116 is fitted in hole 74 of metallic contact 50 and connected to the contacts by soldering or other appropriate means. Conductive spring 52 exerts a downward force on conductive rod 54.

Non-conductive bar or roller 56 engages slot 118 on conductive rod 54. The function of roller 56 will be discussed in detail below.

Polymeric contact base 58 comprises four arcuate section 120, 122, 124, and 126 each spanning a 90° arc. These arcuate sections are arranged in a circle. The upper surface of each arcuate section is upwardly slanted. The upper surfaces of the arcuate sections thus form a sawtooth-like structure.

Low terminal 60 has an integral contact portion 128. Contact portion 128 is arcuate and bent to conform to the upper surface of portion 122 of contact base 58.

High terminal 62 has contact surface portions 130 and 132 integrally formed therewith. Contact surface portions 130 and 132 are arcuate and bent to conform to the upper surfaces of sections 124 and 126, respectively, of contact base 58.

Contact surface portions 128, 130, and 132 will be referred to hereinafter as contact surfaces.

The remaining section 120 of contact base 58 does not have a terminal on its upper surface.

In the first embodiment, a ridge 134 is integrally formed on the upper surface of contact surface 128. Ridge 134 extends above contact surface 128 a distance greater than a separation distance from the surface of hole 136 to the nearest point on surface 138 of roller 56. Why the height of ridge 134 exceeds this separation distance will become apparent below.

When the above-described components are assembled, contact support member 58 and terminals 60 and 62 are firmly held within actuator housing 69 so that they will not rotate around axis 40. Plastic rotator 68 is supported within polymeric housing 69 such that it freely rotates about axis 40 immediately above contact support member 58 and contact surfaces 128, 130, and 132.

Conductive rod 54 is held in slot 112. Its ends contact either (a) contact surfaces 130 and upper non-conductive surface 140 of section 120; or (b) contact surfaces 128 and 132. The downward force exerted by spring 114 on conductive rod 54 holds rod 54 against the appropriate contact surfaces of contact support members 58. Further, an electrical circuit is formed from the supply conductor 6 in power cable 4 through metal contact 50 to conductive rod 54. The effects of the different patterns of electrical contact between the ends of conductive rod 54 and the various contact surfaces will be described in detail below.

Referring now to FIG. 1, conductive rod 54 is rotated about axis 40 in the following manner.

A downward force is exerted on pull-chain 42. The downward force is changed into a horizontal force by chain support member 48 and slot 141 in casing 69. This horizontal force rotates projection 98 in slot 141 in a counterclockwise direction shown by arrow 142 in FIG. 2. The sides of projection 96 and slot projection 98 act on vertical faces 144 on its middle portion 102 to rotate plastic rotator 68 in the direction shown by arrow 142. As plastic rotator 68 rotates, the relation between groove 112 and conductive rod 54 causes the rod to rotate in the same direction. Because the surfaces of arcuate sections 120, 122, 124 and 126 are upwardly slanted, these surfaces force conductive rod 54 upwardly into slot 112 against the force of conductive rod 52 as rod 54 rotates. When the conductive rod 54 reaches the tops of the slanted, arcuate surfaces, it drops down to the surface of the next arcuate section (vertical surfaces 148 prevent conductive bar 54 from rotating backwards against arrow 142).

At that point, projection 98 is stopped by a projection 146 on the actuator housing 69. When the pull-chain 42 is released, rotation spring 64, which is attached to projection 98, forces metal rotator 66 in a direction opposite to the direction indicated by arrow 142. Because conductive bar 54 is stopped by vertical surfaces 148, plastic rotator 68 cannot rotate in the direction opposite that indicated by arrow 142. Instead, the tabs 96 and projection 98 slide over flat surfaces 100, up inclined planes 148, and down onto adjacent flat surfaces 100.

With each chain-pull, therefore, plastic rotator 68 and conductive bar 54 are rotated 90° in the direction indicated by arrow 142. Metal rotator 66, on the other hand, is rotated 90° in the direction indicated by arrow 142 and then 90° in the opposite direction.

Figure 3:
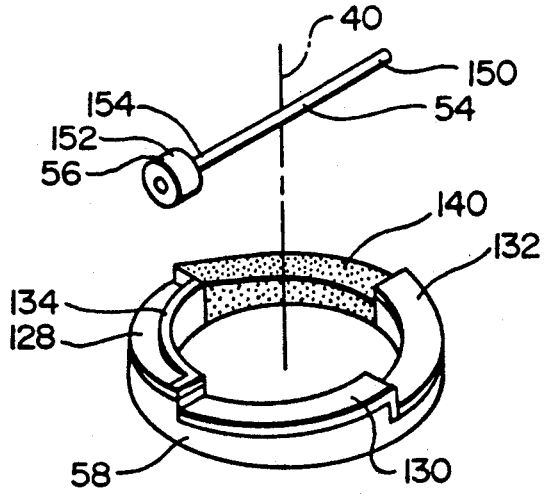
FIG. 3 depicts the switching mechanism of a first embodiment of the present invention.

The electrical connections formed by rotating conductive bar 54 in 90° increments will now be explained with reference to FIGS. 3–7. FIG. 3 depicts the major components of the switching device of the first invention including conductive rod 54 with non-conductive roller 56 attached thereto. End 150 of conductive rod 54 is not insulated and will hereinafter be referred to as the conductive end. End 152 will be referred to as the non-conductive end. Indicated by reference character 154 is a conductive part of non-conductive end 152. Only the flow of positive electrical current will be described, as negative current will flow in the opposite direction through the same path.

Figure 4:
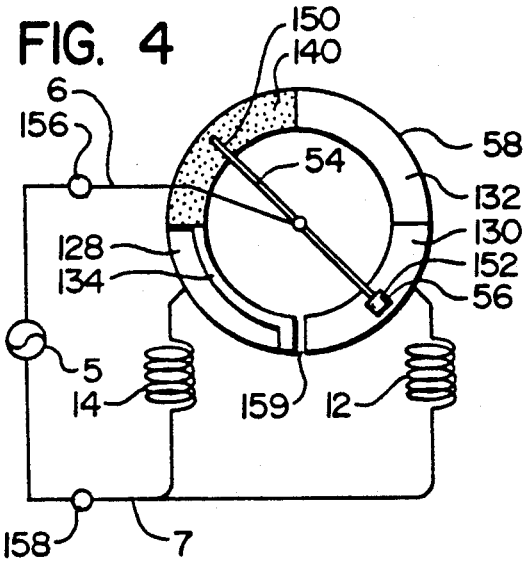
FIGS. 4–7 are schematic drawings illustrating the electrical connections formed by rotating a conductive bar of the switching mechanism about the axis of a circular arrangement of electrical contacts.

FIG. 4 depicts an "OFF" situation in which neither filament 12 nor filament 14 is energized. Reference characters 156 and 158 indicate the supply and return terminals of the AC power supply 5, respectively. The gap at reference character 159 indicates that contact surfaces 128 and 130 are not electrically connected. Conductive bar 54 is electrically connected to the supply terminal 156. However, conductive end 150 is in contact with non-conductive surface 144; and roller 56 of non-conductive end 152 is in contact with contact surface 130. Current is thus prevented from flowing through either filament. The multi-filament electric lamp is therefore "OFF".

Figure 5:
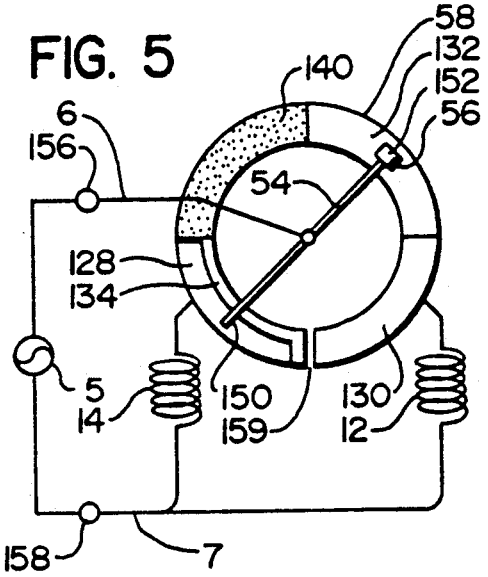

FIG. 5 depicts a "LOW" configuration in which only the low filament 14 is energized. Positive current flows from supply terminal 156, through the center of conductive bar 54, through the contact made by conductive bar end 150 and contact 128, and through low filament 14. However, as only the roller 56 on non-conductive bar end 152 contacts contact surface 132, current is prevented from flowing through high filament 12. Thus, only low filament 14 is energized.

Figure 6:
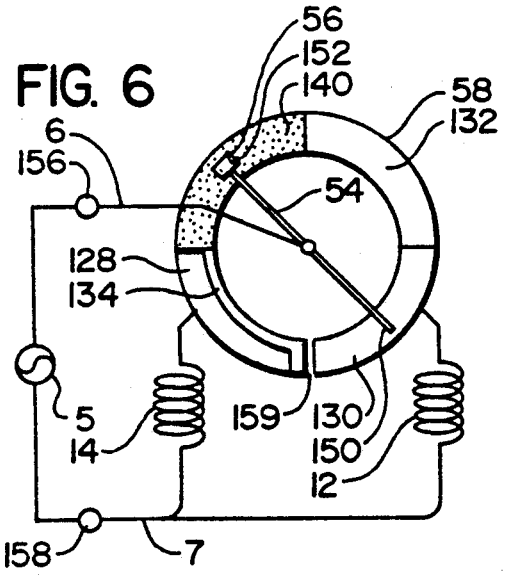

FIG. 6 illustrates the switch configuration employed when a medium emission of light from multi-filament lightbulb 8 is wanted. Positive current flows from supply terminal 156 to contact surface 130 via conductive bar end 150. High filament 12 is thus energized. Roller 56 on non-conductive end bar 152 prevents current from flowing through low filament 14. With light emitted only by high filament 12, light of medium intensity is generated.

Figure 7:
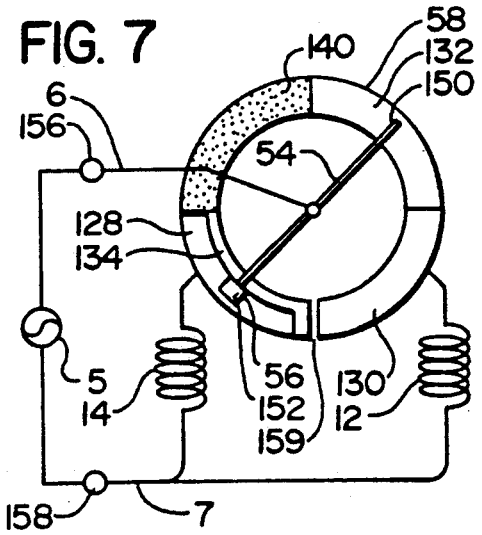

FIG. 7 depicts the switch configuration in which light of the highest—"HIGH"—intensity is outputted by light bulb 8. Positive current flows through high terminal 12 from supply terminal 156 via conductive bar end 152 and contact surface 132. Ridge 134 is in contact with the conducting portion 154 of non-conductive end 150 because ridge 134 is higher than the separation distance of roller 56. Accordingly, positive current is also allowed to flow from supply terminal 156 through low terminal 14 via conductive bar portion 154 and contact surface 128. Filaments 12 and 14 are both energized. The energization of both of high filament 12 and low filament 14 yields light of "HIGH" intensity.

Figure 8:
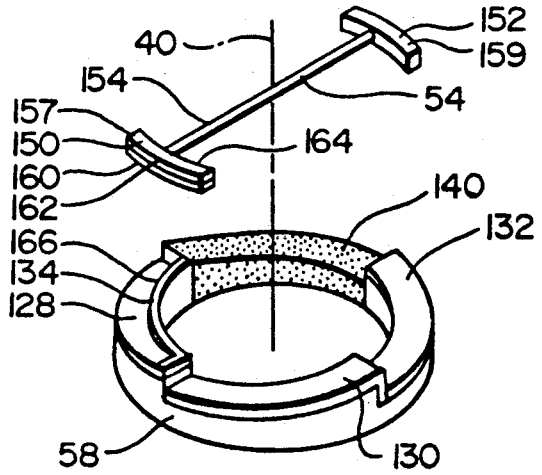
FIG. 8 is a perspective view of the switching mechanism which is a second embodiment of the present invention.
Figure 9:
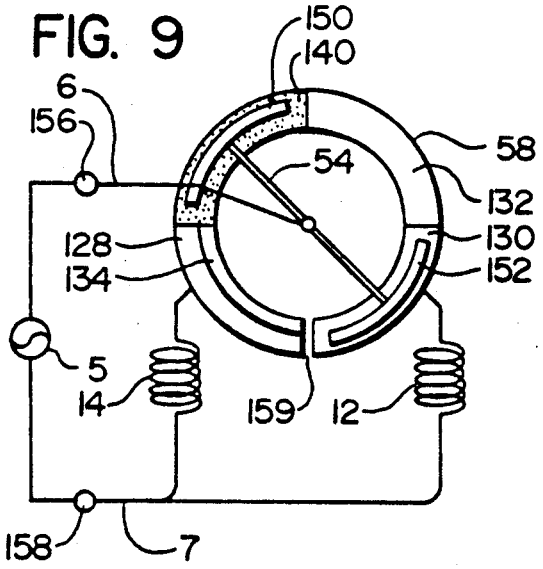
FIGS. 9–12 schematically depict the electrical connections formed by rotating a conductive bar about the axis of a circular arrangement of contacts of the FIG. 8 switching mechanism.
Figure 10:
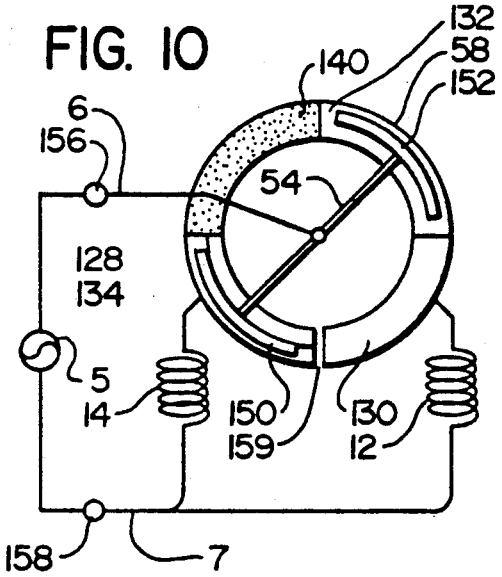
Figure 11:
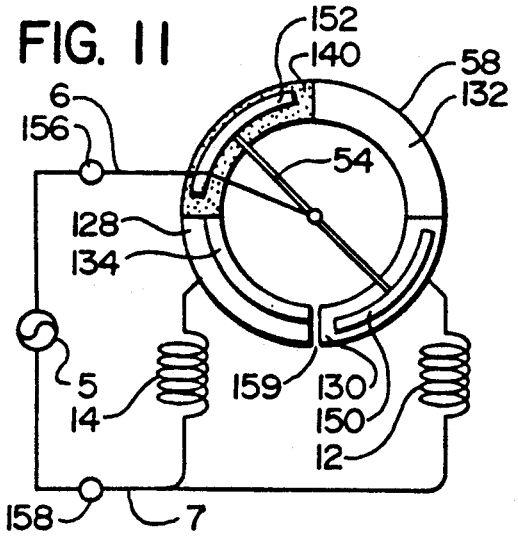
Figure 12:
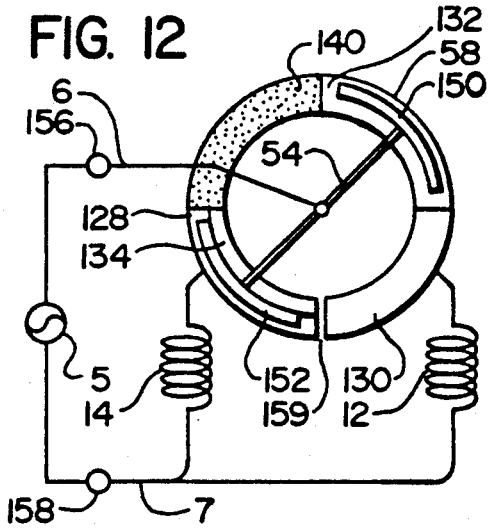

FIG. 8 depicts a second embodiment of the present invention. Components that are the same as components in the first embodiment are given the same reference characters and will not be discussed in further detail.

Non-conductive end 150 and conductive end 152 of rotary conductive bar 54 are modified in the second embodiment. Elongate, arcuate members 157 and 159 are placed on bar ends 150 and 152, respectively. Arcuate member 159 provides a broad area for contacting contacts 128, 130, and 132 for use in higher power applications. End member 157 has a non-conductive layer 160 and a conductive layer 162 on the top thereof. Non-conductive layer 160 insulates conductive rod 54 from contact surfaces 130 and 132.

Conductive layer 162 has approximately the same radius of curvature as ridge 134 and contact surface 128 and can be designed such that its inner surface 164 contacts an outer surface 166 of ridge 134. Accordingly, greater surface area is presented for electrical contact between conductive rod 54 and contact surface 128.

Figure 13:
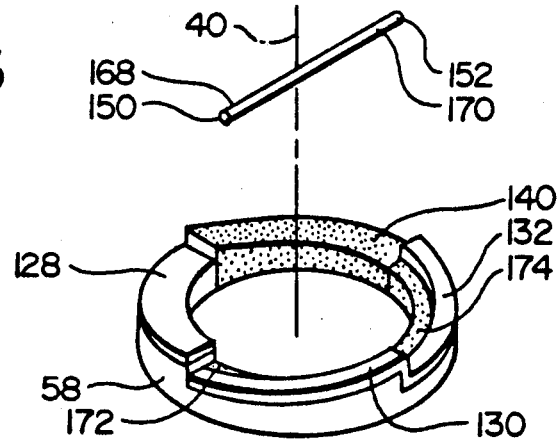
FIG. 13 is an illustration of a third embodiment of the present invention.

The second embodiment works in the same basic manner as the first embodiment. In the FIG. 9, OFF configuration, current is not allowed to flow through high filament 12 or low filament 14, In the FIG. 10, low configuration current is allowed to flow only through low filament 14. In the FIG. 11 configuration, current is allowed to flow only through filament 12 thereby providing light of "MEDIUM" tensity. In the configuration depicted in FIG. 12, current is allowed to flow both through high filament 12 and low filament 14. The energization of both filaments yields light of "HIGH" intensity.z A third embodiment of the present invention is depicted in FIG. 13. Again, like components are identified by the same reference characters.

In the third embodiment, conductive bar 54 is not symmetrical about axis 40. Instead, section 168 is shorter than section 170. Also in this embodiment, contact surface 128 does not have a ridge formed thereon.

Furthermore, contacts 130 and 132 do not extend entirely across the radial width of contact support members; instead, contact surfaces 172 and 174 of contact support member 58 are exposed.

Figure 14:
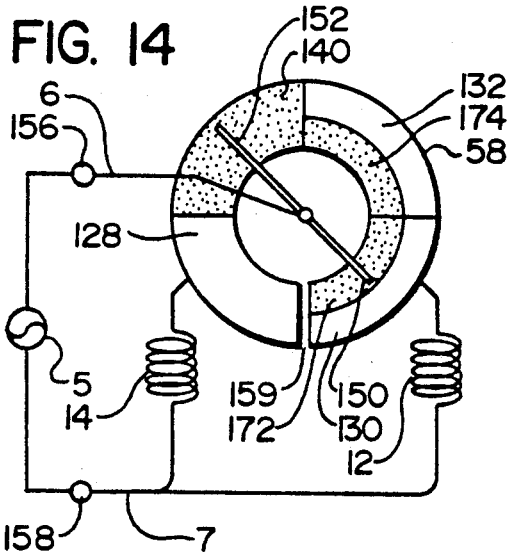
FIG. 14–17 schematically depict the electrical connections formed by rotating a conductive bar of the third embodiment about the axis of a circular arrangement of contacts.

Finally, as shown in FIG. 14, conductive bar end 150 does not extend far enough to make physical contact with contact surface 130. Therefore, and because contact support member 58 is non-conductive, current cannot flow through the ends of conductive rod 54 or into either filament. Lightbulb 8 is therefore "OFF" when conductive rod 54 is in the position shown in FIG. 14.

Figure 15:
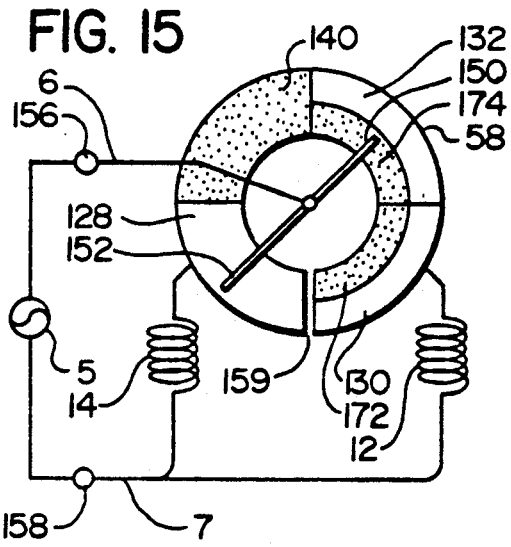

In the FIG. 15 position, current is similarly prevented from flowing through high filament 12 because end 150 of conductive rod 54 does not reach contact surface 132. However, current is allowed to flow through low filament 14 because end 152 of conductive rod 54 makes electrical contact with contact 128. Light having "LOW" intensity is therefore generated by lightbulb 8.

Figure 16:
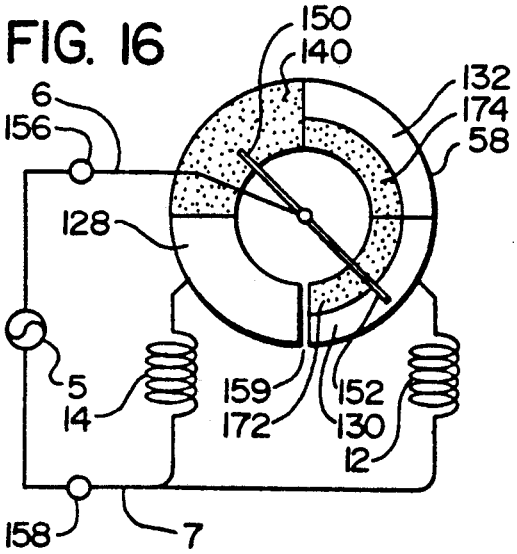

In the FIG. 16 position, longer end 152 of conductive rod 54 extends past non-conductive surface 172 onto contact 130. Current thus flows through filament 12 and contact 130. However, end 150 of bar 54 contacts non-conductive surface 140; therefore, current does not flow through low filament 14. Light of "MEDIUM" intensity is therefore generated by electric light bulb 8.

Figure 17:
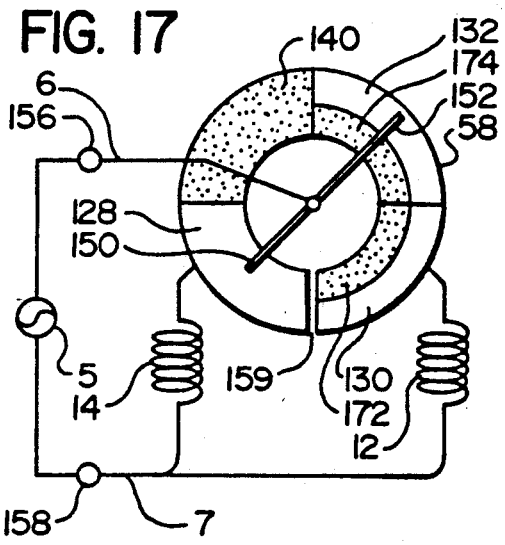

In the FIG. 17 configuration of the switching mechanism, conductive end 150 of bar 54 contacts contact surface 128; and current thus flows through low filament 14. At the same time, bar end 152 extends past non-conductive surface 174 to contact contact surface 132. Current is thus also allowed to flow through high filament 12. The combined output of filaments 12 and 14 yields light of "HIGH" intensity.

Many modifications and alterations of the above-discussed representative embodiments may be made without departing from the spirit of the present invention. For example, the preferred embodiments have an "OFF" state in which neither of two filaments in the electric lamp are energized. Such an "OFF" state may instead achieved by placing a standard two-way switch between the AC power source and the switch mechanism of the present invention. In this case, another electrical contact surface and filament may be employed to provide more luminosity states.

Further, four contact portions each spanning a 90° arc are combined to form a circular arrangement in the above disclosed representative embodiments. More arcuate contact surfaces, each spanning a smaller arc may be employed, allowing the use of more than two filaments in the multi-filament lamp. In this case, the pull-chain rotation actuator would be designed to provide movements of the conductive rods in increments of less than 90°.

Additionally, any combination of: (a) modifications of the ends of the conductive rod, and (b) arrangements of contacts on the contact support member may be employed to achieve the effect of disconnecting and/or connecting one or more ends of the conductive rod from or to one or more of the contact surfaces.

The invention may also be embodied in still other forms without departing from the spirit of essential characteristics of the present invention. The specifically disclosed and alternate embodiments are therefore to be considered in all respects as illustrative and not restrictive, the scope of the invention being indicated by the appended claims rather than by the foregoing description and the drawings. All changes which come within the meaning and the range of equivalency of the claims are therefore intended to be embraced therein.

I claim:

1. A pull-chain actuate electric switch mechanism for a multi-filament electric lamp having a plurality of distinct filaments, comprising:

a plurality of electrical contacts arranged in a circular array, each electrical contact being electrically connectable to a filament of the multi-filament lamp;

a pull-chain;

a contactor having end portions said contactor being mounted for rotation about the axis of the symmetry of the circular array in response to displacement of said pull-chain to bring end portions of the conductive bar into contact with the electrical contacts;

a conductive member electrically connectable at a first end to an electrical power source and at a second end to a center portion of the contactor, where the pattern of the electrical contacts is such that rotation of the contactor about said axis of symmetry into a given position results in current flowing from the center portion of the contactor, to both ends of the contactor, and through at least two of the electrical contacts to energize at least two of the plurality of distinct filaments of the multi-filament lamp; and means for electrically isolating a first end of the contactor from a first electrical contact of said plurality of electrical contacts and thereby preventing the flow of electrical current to the filament connected to that first electrical contact when the contactor is in a position in which its first end is in contact with said first electrical contact;

in which the means for isolating said contactor from said first electrical contact comprises: an insulating member so located at the first end of the contactor as to engage said first electrical contact when said first contactor end is engaged with that first electrical contact; and wherein a second electrical contact of said plurality of electrical contacts of the switch mechanism has: a bounding conductive ridge which is contactable by a portion of said first contactor end adjacent the insulating member to allow current to flow from the first end of the contactor through that second electrical contact to a lamp filament electrically connected to the second electrical contact.

2. An electric switch mechanism as defined in claim 1, in which the conductive member is a metallic spring arranged to bias the contactor against the contacts.

3. A pull-chain actuated, electric switch mechanism for a multi-filament electric lamp having first and second filaments which are adapted to be connected to an electric power source, said switch mechanism comprising:

a non-conductive contact support having first through fourth, arcuate, upwardly slanted, contact support surfaces in a circular, saw-tooth array;

a first electrical contact electrically connected to a first filament of the lamp, said first contact being located on the first support surface;

a second electrical contact electrically connected to a second filament of the lamp, said second contact spanning and being supported on said second and third support surfaces;

a contactor with end portions, said contactor being mounted for rotation about the axis of symmetry of the contact support surfaces array;

means for so rotating said contactor about said axis in response to displacements of a pull-chain as to bring end portions of the contactor into contact with said first and second, electrical contacts;

a conductive member electrically connected at a first end to the electrical power source and at a second end to a center portion of the contactor; and means for electrically isolating a first end of the contactor from the second contact when a second end of said contactor is in contact with the first contact, said means for electrically isolating the first end of the contactor comprises: (a) an insulating member at the first end of the contactor which keeps current from flowing through said second electrical contact when said first contactor end is positioned over said second contact; and (b) wherein there is a ridge on the first electrical contact which is engagable by a conductive portion of the first contactor end to allow electric current to flow from said first end to said first contact when the contactor is aligned with that contact; whereby rotation of the contractor by the pull-chain actuated contactor rotating means allows current to flow from the contactor rod through the electrical contacts to energize various filaments of the multi-filament lamp and/or at least one combination of such filaments.

4. An electric switch mechanism as defined in claim 3, in which the pull-chain actuated means rotates the contactor in 90° increments with each displacement of the pull-chain.

5. An electric switch mechanism as defined in claim 3 in which the contactor can be rotated to:

a first, off position in which a second end of the contactor does no touch an electrical contact and a first end of the contactor touches the second contactor:

a second, low position in which the second end of the contactor touches the first contact and first end of the contactor touches the second contact;

a third, medium position in which the second end of the contactor touches the second contact and the first end of the contactor does not touch a contact; and a fourth, high position in which the second end of the contactor touches the second contact and the first end of the contactor touches the first contact;

the connections between the electrical contacts and the filaments of the lamp being such that said lamp: (a) does not emit light when said contactor is in the first position and (b) emits light of low, medium, and high intensity when said contactor is respectively in the second, third, and fourth positions.

6. An electric switch mechanism as defined in claim 3, in which the insulating member is attached to the first end of the conductive bar.

7. An electric switch mechanism as defined in claim 3, in which:

conductive members configured to slide along said first and second contacts are provided at the first and second ends of the contactor; and the insulating member is located on the conductive member at the first end of the contactor.

8. A pull-chain actuated switch and socket mechanism for an electric lamp having: (a) high and low filaments; (b) an externally threaded base electrically connected to both the high and low filaments; (c) a high contact electrically connected to the high filament, and (d) a low contact electrically connected to the low filament, the switch and socket mechanism comprising:

a socket having: (a) an internally threaded component which is electrically connectable to an AC power source and is adapted to receive the threaded base of the lamp; (b) a first conductive member for making electrical contact with the high contact of the lamp; and (c) a second conductive member for making electrical contact with the low contact of the lamp;

a non-conductive contact support member having first through fourth, upwardly slanted support surfaces in a circular saw-tooth array.

a first metallic contact electrically connected to the first conductive member, said first contact having a ridge along an inner edge thereof;

a second metallic contact electrically connected to the second conductive member, said second contact having first and second segments respectively supported on the second and third support surfaces of the contact support;

a conductive contactor with first and second end portions, said contact or being mounted for rotary movement about the axis of symmetry of the array of contact support surfaces;

a pull-chain actuated, rotatable means for so rotating said contactor about said axis of symmetry in response to successive displacements of the pull-chain as to bring the first and second end portions of the conductive bar into contact with support surfaces in opposing quadrants and contacts supported thereon;

a conductive biasing means: (a) electrically connectable at a first end to a supply terminal of the AC power source; (b) electrically connected at a second end to a middle portion of the commutator; and (c) so configured and located as to apply a force on the contactor which will keep the ends of the contactor in contact with the support and contact surfaces; and a non-conductive member at the first end of the commutator, said first end of the contactor bar and the non-conductive member being so dimensioned that, as said contactor is rotated to different ones of its positions: (a) the non-conductive member will touch a segment of said second contact, and (b) a conductive portion of said first end will touch the ridge on the first contact and allow current to flow from the contractor to the first contact.

* * * * *